US010046444B2

(12) United States Patent
Chang

(10) Patent No.: US 10,046,444 B2
(45) Date of Patent: Aug. 14, 2018

(54) MULTIPLE-FUNCTION TOOL

(71) Applicant: Jason Chang, Taichung (TW)

(72) Inventor: Jason Chang, Taichung (TW)

( * ) Notice: Subject to any disclaimer, the term of this patent is extended or adjusted under 35 U.S.C. 154(b) by 287 days.

(21) Appl. No.: 15/206,312

(22) Filed: Jul. 11, 2016

(65) Prior Publication Data

US 2018/0009091 A1 Jan. 11, 2018

(51) Int. Cl.

| | |
|---|---|
| ***B25B 23/00*** | (2006.01) |
| ***B25F 1/02*** | (2006.01) |
| ***B25B 15/00*** | (2006.01) |

(52) U.S. Cl.

CPC ..... *B25B 23/0035* (2013.01); *B25B 15/005* (2013.01); *B25B 15/007* (2013.01); *B25B 15/008* (2013.01); *B25F 1/02* (2013.01)

(58) Field of Classification Search

CPC . B25B 23/0035; B25B 15/005; B25B 15/007; B25B 15/008; B25B 13/56; B25F 1/02; B25F 1/03; B25F 1/04; B25G 1/085

See application file for complete search history.

(56) References Cited

U.S. PATENT DOCUMENTS

| | | | | |
|---|---|---|---|---|
| 7,237,987 | B2 * | 7/2007 | Hernandez, Jr. | B23B 31/201 279/14 |
| 9,162,346 | B2 * | 10/2015 | Chen | B25B 13/06 |
| 2003/0084758 | A1 * | 5/2003 | Chiang | B25G 1/085 81/490 |
| 2014/0331824 | A1 * | 11/2014 | Cumma | B25B 13/005 81/124.5 |

* cited by examiner

*Primary Examiner* — Robert Scruggs

(57) ABSTRACT

A tool includes a first body, a rotary member, a positioning unit and an engaging unit. By the positioning unit and the engaging unit, the rotary member is positioned relative to the first body with dual-positioning feature. When the first body is rotated, the rotary member is positioned by the positioning unit and the engaging unit. The rotary member is not likely to freely rotate because both of the positioning unit and the engaging unit fail when using the tool.

10 Claims, 15 Drawing Sheets

MULTIPLE-FUNCTION TOOL

BACKGROUND OF THE INVENTION

1. Fields of the Invention

The present invention relates to a tool, and more particularly, to a tool with a positioning unit and an engaging unit, the rotary member is positioned to the body by the dual-positioning feature by the use of the positioning unit and the engaging unit.

2. Descriptions of Related Art

The conventional multiple size socket as disclosed in U.S. Pat. No. 9,162,346B2, Taiwan Patent Application No. 102208919 with the certificate number M464273, comprises a base with a connecting portion, two pivot portions and a pivot hole formed in each of the pivot portions. A socket body is pivoted between the two pivot portions and includes a plurality of engaging cavities which have different sizes. At least one of the pivot holes is formed around the inner surface of the base with a plurality of shoulder portions. A plurality of serrations are formed around the inner surface of the inserting holes. A positioning unit includes a pin and two positioning assemblies. The pin includes a head portion to be abutted against one of the pivot portions, a shaft portion connected to the head portion and inserted through the pivot holes and the inserting hole, a plurality of protrusions formed around the shaft portion and abutted against the shoulder portions, and at least one recess formed in the shaft portion and aligned to the serrations. Each positioning assembly includes a spring received in the recesses, and a ball is received in the recesses and pushed by the spring against the serrations.

However, the shortcomings of the above mentioned socket are that, as shown in the FIG. 2 of the U.S. Pat. No. 9,162,346B2, the inserting holes of the socket body includes serrations in the inner surface thereof, and the pin of the positioning unit has a positioning assembly formed thereon, and the ball of the positioning assembly is biased toward the serrations by the spring so as to adjust the angle that the engaging cavities of the socket body relative to the base. Nevertheless, the socket body is positioned relative to the base by the positioning unit, when the torque is overly applied to the socket body, the serrations push the ball inward which compresses the spring so that the spring fails its resilient biasing feature. The ball cannot be positioned relative to the serrations, and the socket body is able to be freely rotated on the base.

SUMMARY OF THE INVENTION

The present invention intends to improve the above mentioned problem which is caused because that the torque is overly applied to the socket body, and the serrations push the ball inward so that the positioning feature fails. The present invention provides a positioning unit and an engaging unit to provide dual-positioning feature. When the first body is rotated, the rotary member has the dual-positioning feature by the use of the positioning unit and the engaging unit, so that the positioning unit and the engaging unit of the rotary member do not likely fail due to the rotation, and causes the free rotation of the rotary member.

Compared with the function of the prior technics, the second positioning portion of the positioning unit is engaged with the first positioning portion, one of the second bits of the rotary member is engaged with the engaging portion of the engaging member. Therefore, the rotary member is positioned and engaged relative to the first body. When rotating the first body, the first bit or the second bit is rotated, the rotary member is not rotated and remains still. In other words, the rotary member is double-positioned by the positioning unit and the engaging unit. The positioning unit and the engaging unit of the rotary member are not likely to be disengaged because of the rotating force applied thereto to cause the rotary member to rotate freely.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
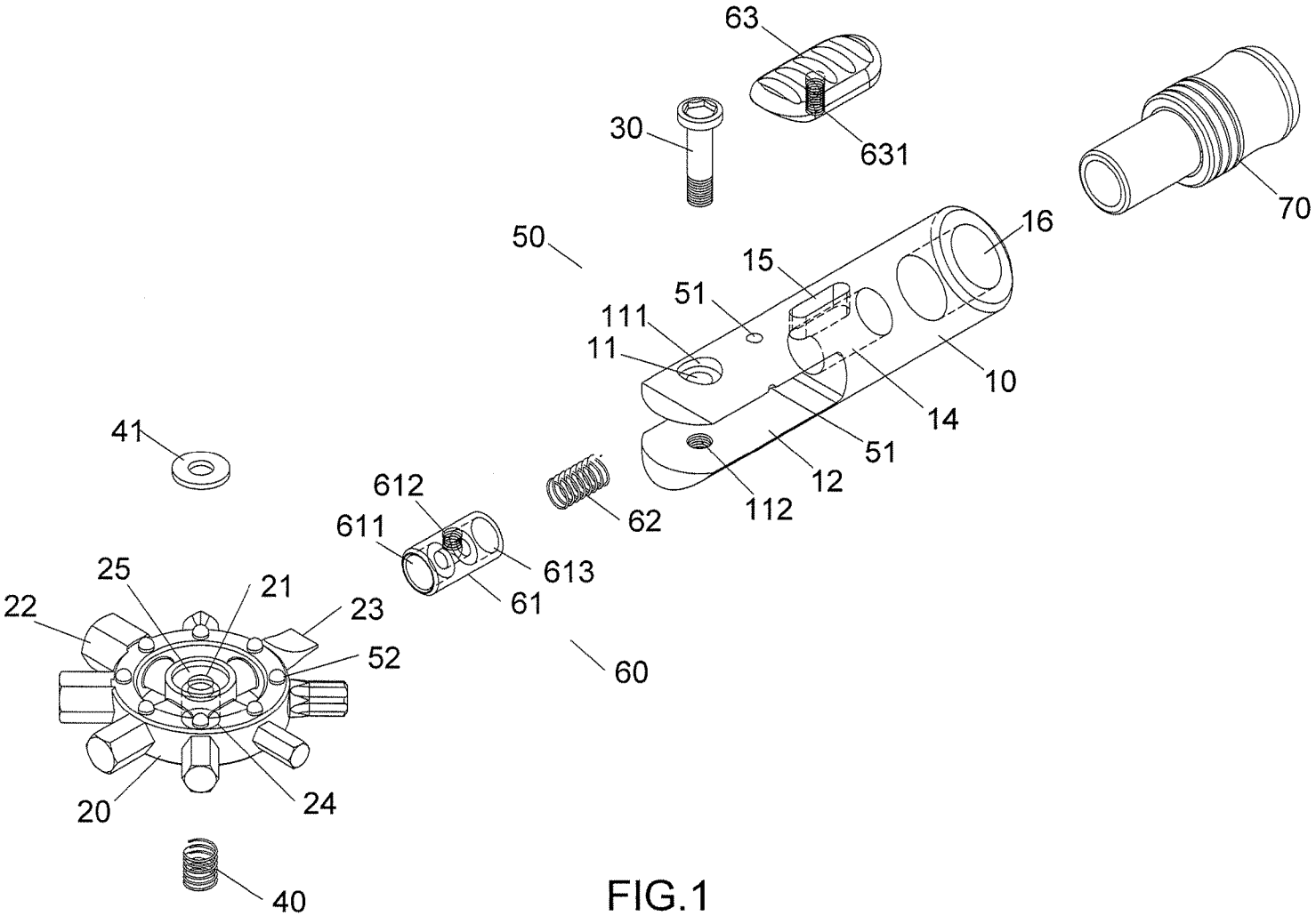
FIG. 1 is an exploded view of the tool of the present invention.

Referring to FIG. 1, the tool of the present invention comprises a first body 10 having a first pivotal portion 11 formed on the first end thereof. The first pivotal portion 11 is a circular hole. A first room 111 and a first connection portion 112 are respectively defined in two opposite sides of the first pivotal portion 11. The first room 111 is an oval recess. An inner diameter of the first room 111 is larger than the inner diameter of the first pivotal portion 11. The first connection portion 112 has inner threads. The first body 10 has an opening 12 which communicates with the first pivotal portion 11. A second room 14 is defined in the inner end of the opening 12 and communicates with the opening 12. The second room 14 is a cylindrical room. A slot 15 is defined in the body 10 and communicates with the second room 14. The slot 15 is an elongate slot. The slot 15 and the first room 111 are located on a common plane. The first body 10 has a reception portion 16 defined in the second end thereof, and the reception portion 16 is a circular recess.

A rotary member 20 is pivotably connected to the first pivotal portion 11 of the first body 10 and is rotatable in the opening 12. The rotary member 20 has a second pivotal portion 21 formed to the center thereof and the second pivotal portion 21 is located corresponding to the first pivotal portion 11. The second pivotal portion 21 is a circular hole. The rotary member 20 has multiple first bits 22 and multiple second bits 23. The first and second bits 22, 23 are radially connected to the rotary member 20. There are five first bits 22 which have five hexagonal heads of different sizes. There are three second bits 22 which have three bit heads of different sizes. The second pivotal portion 21 has a first recess 24 defined in the first end thereof. The first recess 24 communicates with the second pivotal portion 21. The diameter of the first recess 24 is larger than the diameter of the second pivotal portion 21. The first recess 24 is a circular recess. A third room 25 is defined in the second end of the second pivotal portion 21 and communicates with the second pivotal portion 21. The second pivotal portion 21 is located between the first recess 24 and the third room 25. The diameter of the third room 25 is larger than the diameter of the second pivotal portion 21. The third room 25 is a cylindrical room.

A connector 30 extends through the first and second pivotal portions 11, 21 to pivotably connect the first body 10 to the rotary member 20. The connector 30 has the first end thereof received in the first room 111, and the second end of the connector 30 has outer threads which are threadedly connected to the first connection portion 112.

A first resilient member 40 is located in the first recess 24 of the rotary member 20. The first resilient member 40 mounted to the connector 30 and biased between the inner end of the opening 12 and the inner end of the first recess 24 so that the first body 10 resiliently contacts the rotary member 20 by the first resilient member 40, and the rotary member 20 is rotated relative to the first body 10 with a resilient resistance.

A washer 41 is located in the third room 25 of the rotary member 20 and mounted to the connector 30. The washer 41 is a ring-shaped washer and made of resilient material.

A positioning unit 50 positions the rotary member 20 at the first body 10. When the positioning unit 50 is disengaged, the rotary member 20 is freely rotatable relative to the first pivotal portion 11 so as to adjust an angle of the rotary member 20 relative to the first body 10.

The positioning unit 50 has at least one first positioning portion 51, in this embodiment, there are three first positioning portions 51, and multiple second positioning portions 52. The first positioning portions 51 and the first room 111 are located on a common plane of the first body 10. The first positioning portions 51 are located about the first pivotal portion 11. Each first positioning portion 51 communicates with the opening 12. One of the three first positioning portions 51 is a circular hole which is located between the slot 15 and the first room 111. The other two first positioning portions 51 are respectively located on two sides of the first body 10 and each are a concaved recess.

The second positioning portions 52 are located on the rotary member 20. The number of the second positioning portions 52 is equal to the total number of the first and second bits 22, 23. Each of the second positioning portions 52 is located corresponding to one of the first bits 22 or one of the second bits 23. The first resilient member 40 provides a resilient force which is applied to the rotary member 20 to engage each of the second positioning portions 52 with the first positioning portion 51 corresponding thereto so as to position the rotary member 20 to the first body 10. When one of the second positioning portions 52 is engaged with the first positioning portion 51 which is the circular hole, the two second positioning portions 52 adjacent to the second positioning portion 52 that is engaged with the first positioning portion 51 are engaged with the other two first positioning portions 51 which are the concaved recesses. The multiple second positioning portions 52 are arranged as a circle and each have a protrusion or a boss.

An engaging unit 60 is connected to the first body 10 and is movable in the second room 14. When the engaging unit 60 moves toward the rotary member 20, the engaging unit 60 restricts the second bit 23 and the rotary member 20 is positioned at the first body 10. When the engaging unit 60 moves away from the rotary member 20, the engaging unit 60 does not restrict the second bit 23 and the rotary member 20 is not restricted by the engaging unit 60. The engaging unit 60 comprises an engaging member 61, a second resilient member 62 and a slide button 63.

The engaging member 61 is located in the second room 14 and is movable in the second room 14. The engaging member 61 has an engaging portion 611 on the first end thereof. The engaging portion 611 is a circular recess so as to receive the first bit 22 or the second bit 23 whose outer diameter is smaller than the inner diameter of the engaging portion 611. The engaging portion 611 has a second connection portion 612 which is located corresponding to the slot 15. The second connection portion 612 has inner threads. A second recess 613 is defined in the second end of the engaging member 61 and is a circular recess.

The second resilient member 62 is received in the second recess 613 and biased between the inner end of the second room 14 and the inner end of the second recess 613 so that the engaging unit 60 resiliently contacts the first body 10 by the second resilient member 62. A resilient force of the second resilient member 62 resiliently engages the second bit 23 to the engaging portion 611. The second resilient member 62 is a spring.

The slide button 63 is slidably located in the slot 15 of the first body 10. The slide button 63 drives the engaging member 61 to move in the second room 14. The slide button 63 has a third connection portion 631 which is connected to the second connection portion 612 of the engaging member 61 so as to drive the engaging member 61. The third connection portion 631 has outer threads.

A second body 70 is inserted into the reception portion 16 of the first body 10 and is adapted to be connected with a hand tool. The second body 70 is rotatable when rotating the first body 10.

Figure 2:
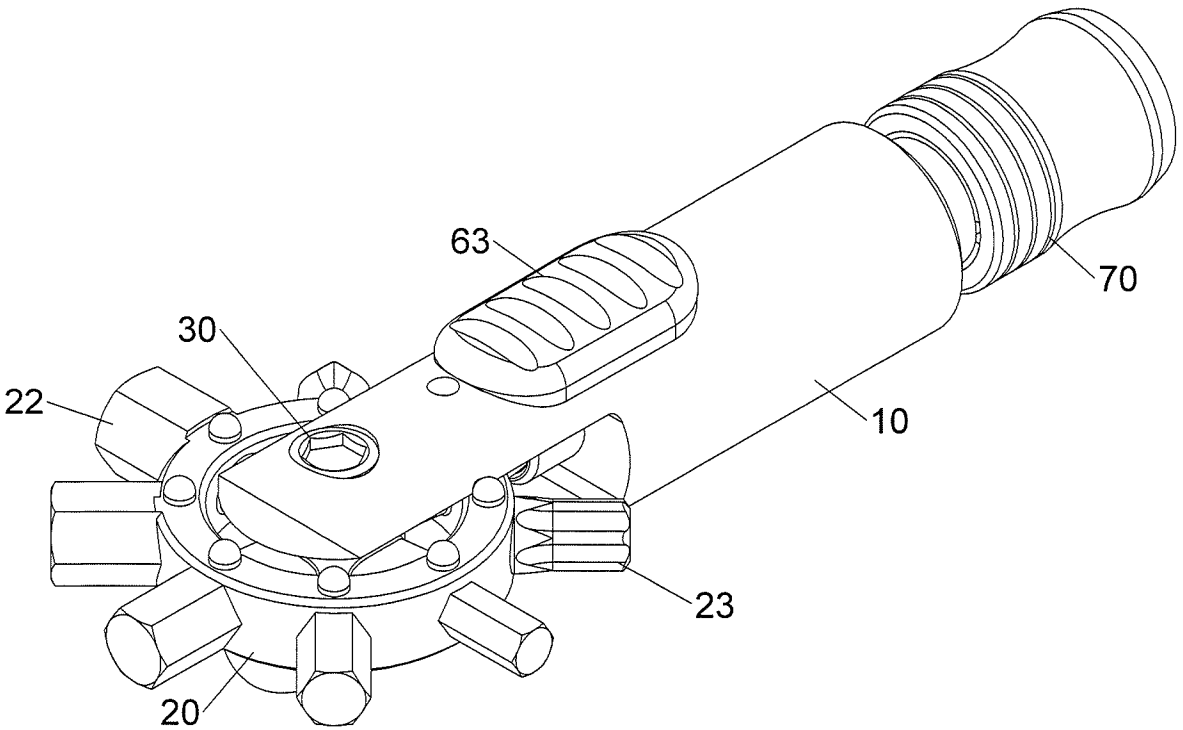
FIG. 2 is a perspective view to show the tool of the present invention.
Figure 3:
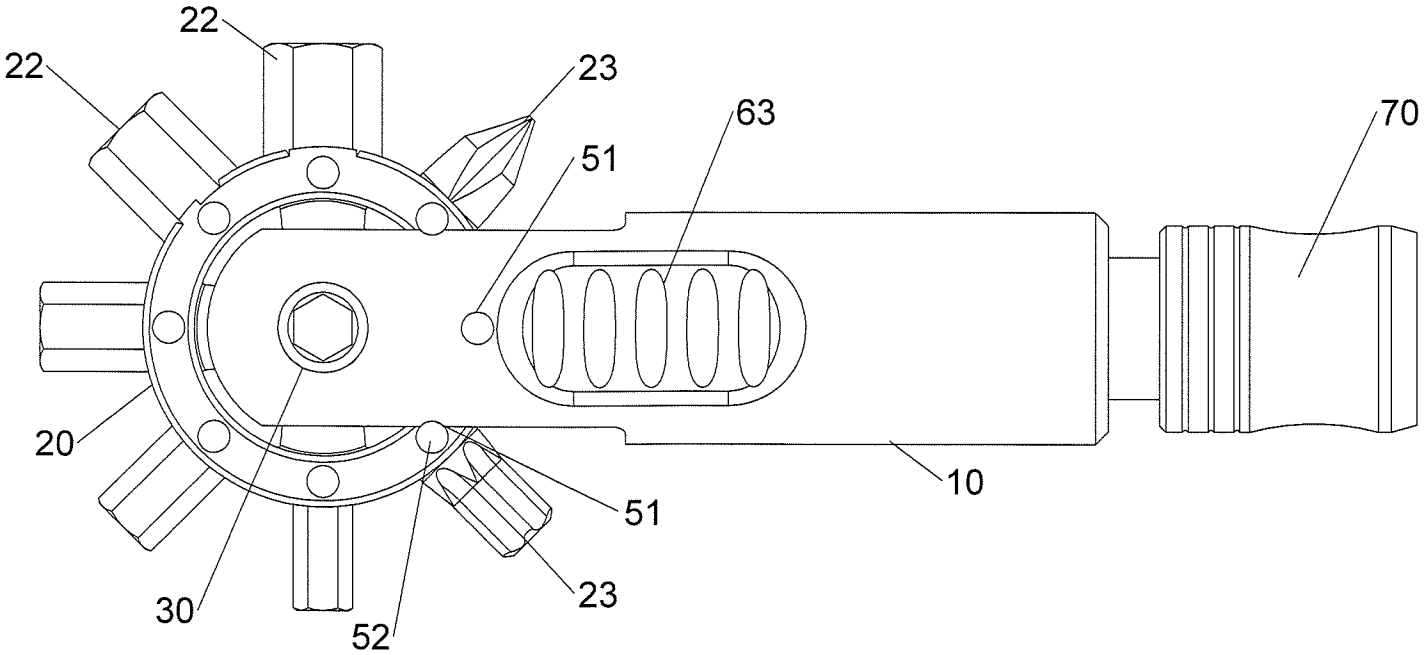
FIG. 3 is a top view of the tool of the present invention.

When assembling the above mentioned parts, the FIG. 2 shows the perspective view of the tool of the present invention. FIG. 3 shows the top view of the tool of the present invention. The FIG. 4 is a front view of the tool of the present invention, and the FIG. 5 is a cross sectional view, taken along line A-A in FIG. 4.

Figure 4:
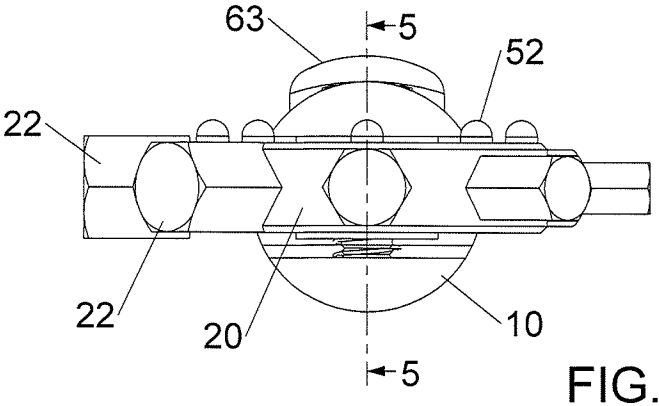
FIG. 4 is a front view of the tool of the present invention.
Figure 5:
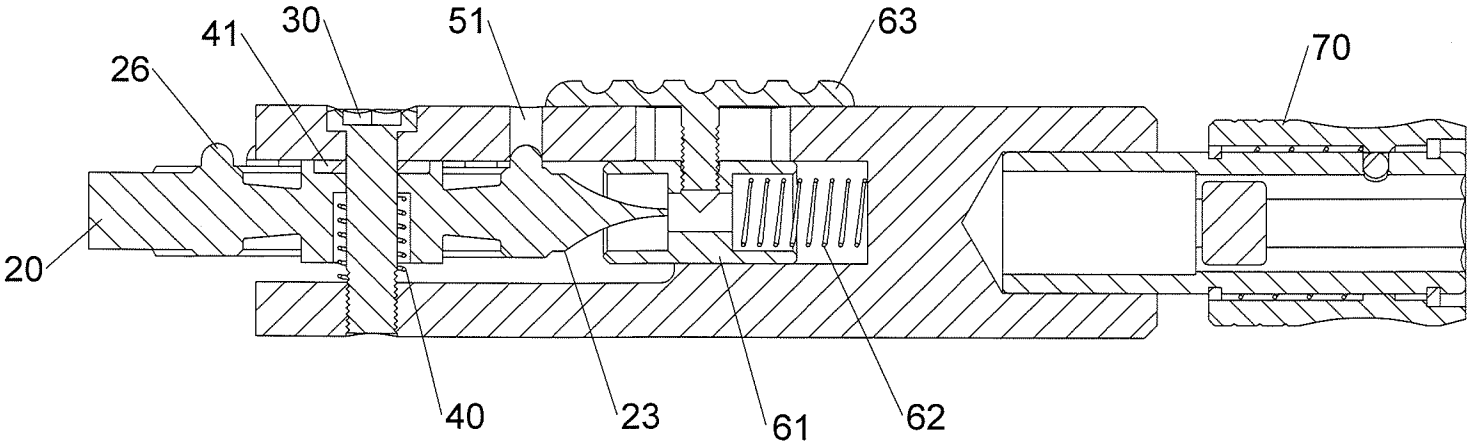
FIG. 5 is a cross sectional view, taken along line 5-5 in FIG. 4.
Figure 6:
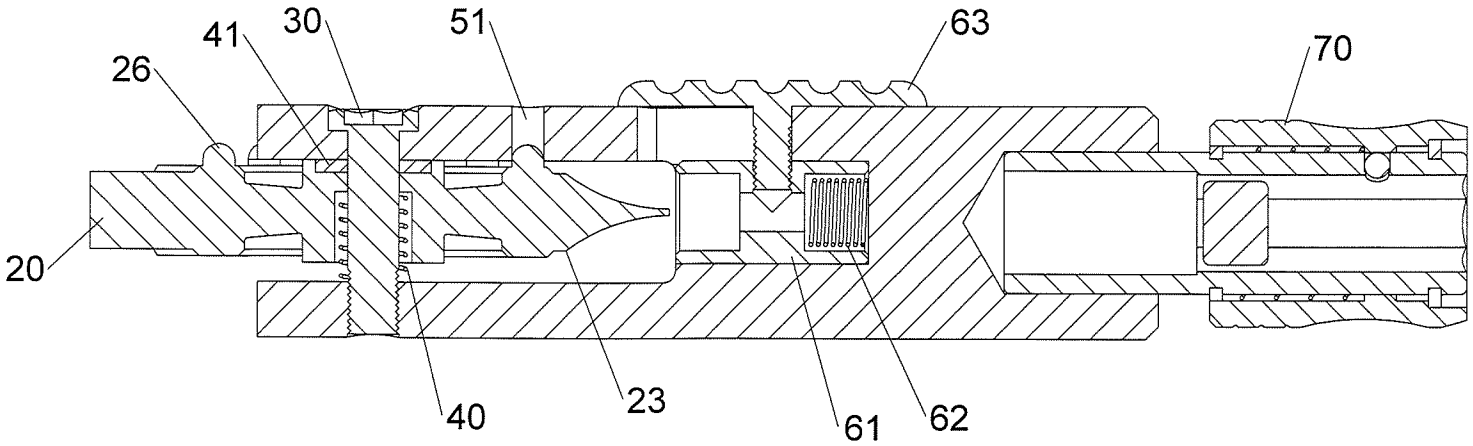
FIG. 6 shows the first disengagement status in the area of 5-5 in FIG. 4.

As shown in FIG. 6, which shows the first disengagement status in the area of A-A in FIG. 4. The slide button 63 of the engaging unit 60 is movable in the slot 15 of the first body 10, when the slide button 63 drives the engaging member 61 within the second room 14 of the first body 10, when the user slide the slide button 63 backward, the engaging member 61 is moved backward by the slide button 63 and compress the second resilient member 62, so that the second bit 23 is disengaged from the engaging portion 611 of the engaging member 61. This is the first disengagement status.

Figure 7:
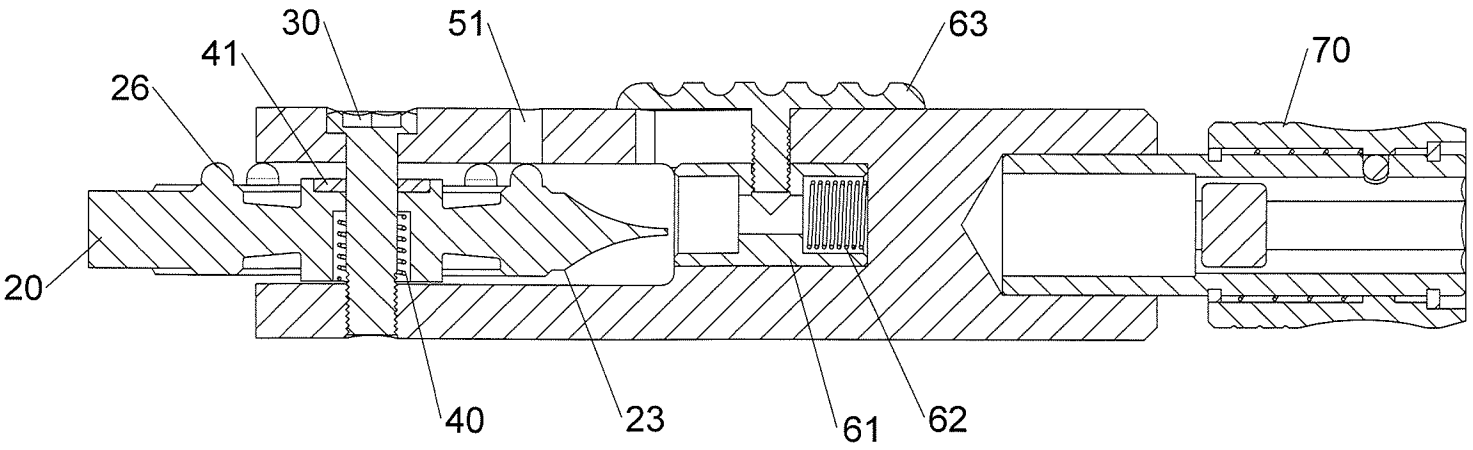
FIG. 7 shows the second disengagement status in the area of 5-5 in FIG. 4.

As shown in FIG. 7 which shows the second disengagement status in the area of A-A in FIG. 4. After the second bit 23 of the rotary member 20 is disengaged from the engaging member 61, the rotary member 20 is pressed downward and compresses the first resilient member 40 to disengage the second positioning portion 52 of the positioning unit 50 from the first positioning portion 51, this is the second disengagement status. Therefore, the rotary member 20 is rotatable about the first pivotal portion 11 and rotatable in the opening 12.

Figure 8:
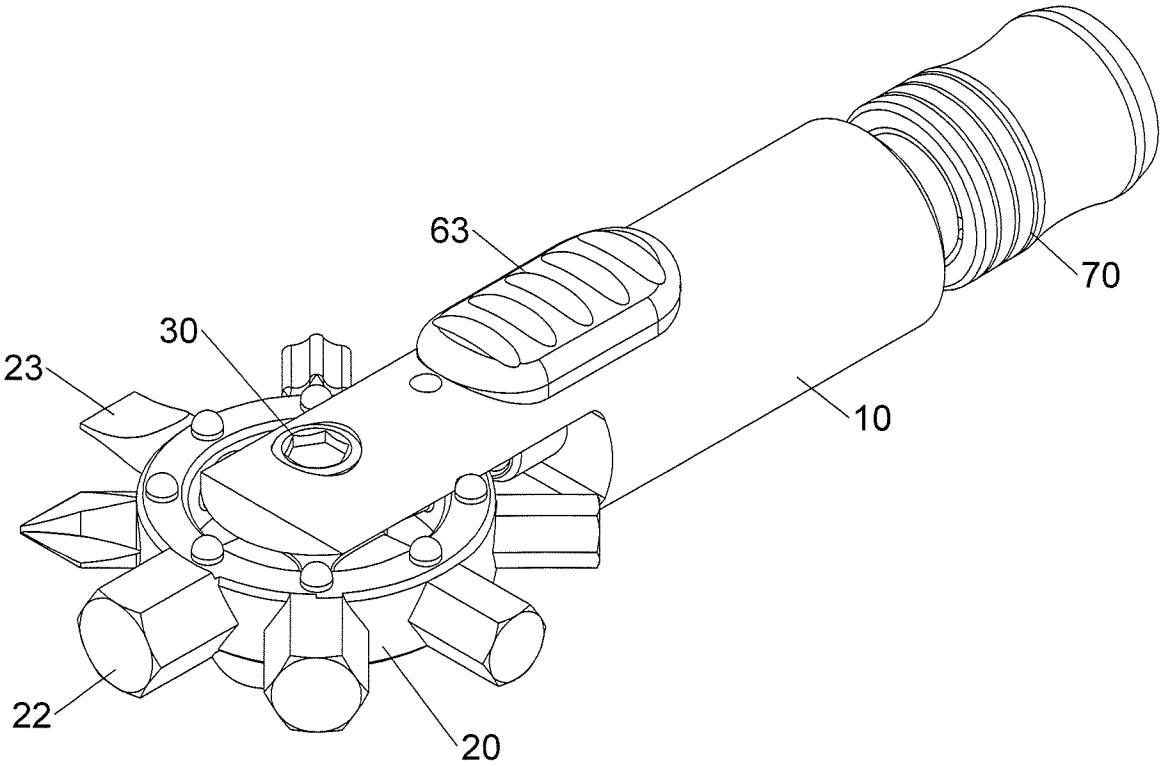
FIG. 8 is a perspective view to show another operational status of the tool of the present invention.

As shown in FIG. 8, which shows another operative status, when compared with the disclosure in FIG. 2, when the rotary member 20 is rotated to the position where the first bit 22 or the second bit 23 is positioned, the rotary member 20 and the slide button 63 are released, so that the first and second resilient members 40, 62 bounce back. The second positioning portion 52 is positioned at the first positioning portion 51. One of the first bits 22 or one of the second bits 23 is engaged with the engaging portion 611, and the rotary member 20 is positioned and cannot freely rotate.

Figure 9:
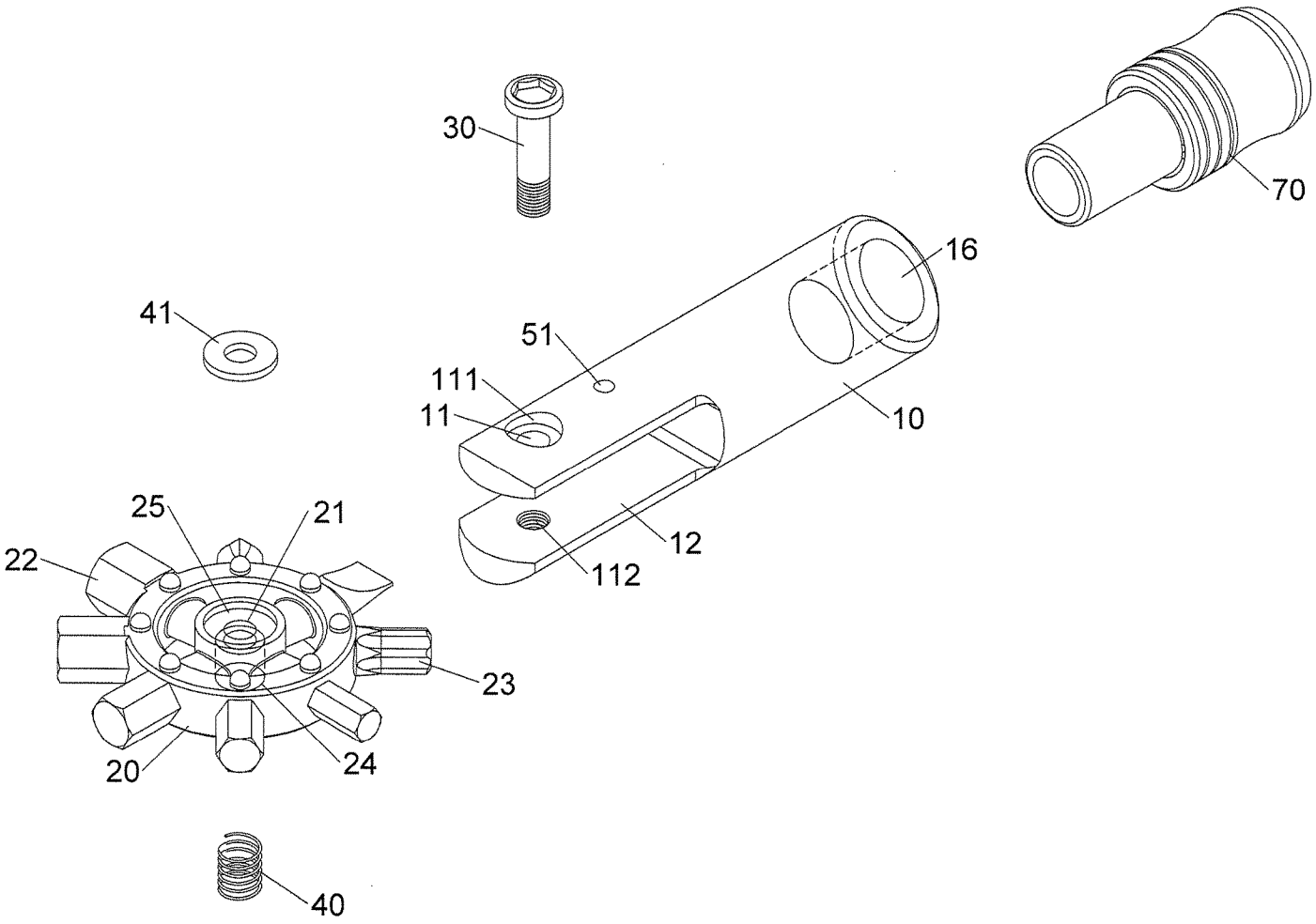
FIG. 9 is an exploded view of the second embodiment of the tool of the present invention.
Figure 10:
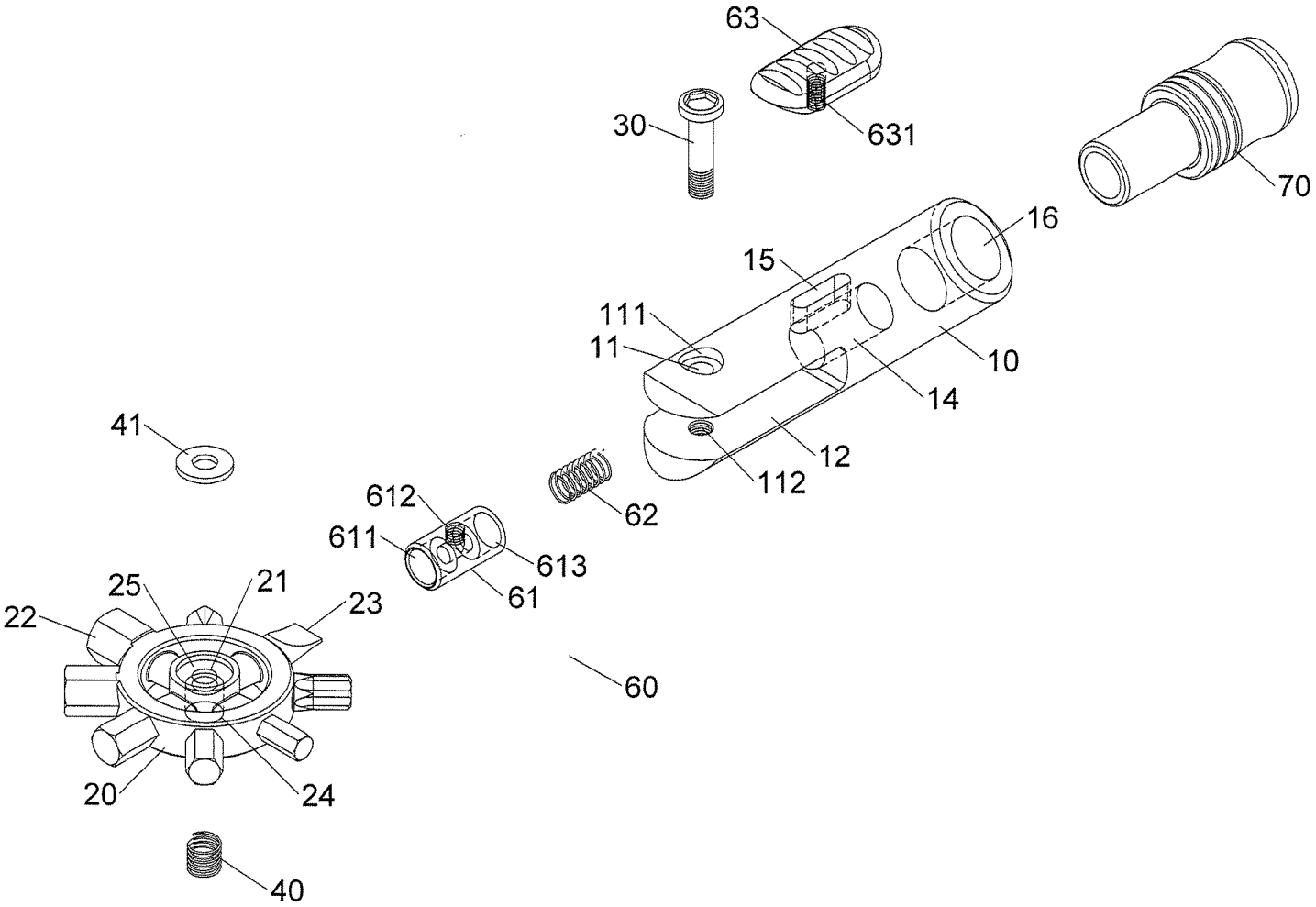
FIG. 10 is an exploded view of the third embodiment of the tool of the present invention.

As shown in FIG. 9 which shows the second embodiment of the present invention, wherein the first body 10 does not have the second room 14, the slot 15 and the engaging unit 60. The rotary member 20 is positioned at the first body 10 by the second positioning portion 52 and the first positioning portion 51. The rotary member 20 is positioned at the first body 10 with only one positioning feature.

Figure 11:
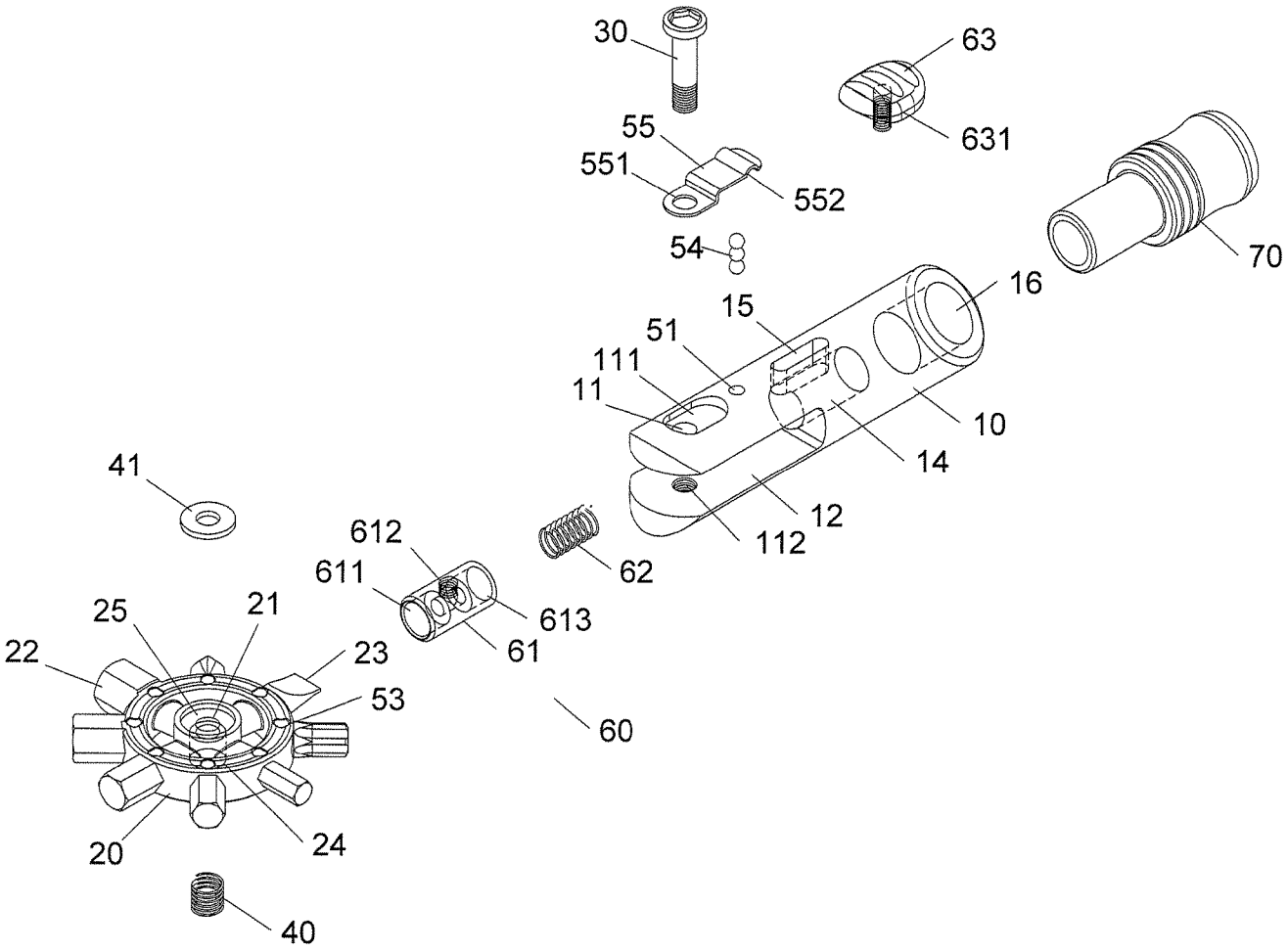
FIG. 11 is an exploded view of the fourth embodiment of the tool of the present invention.
Figure 12:
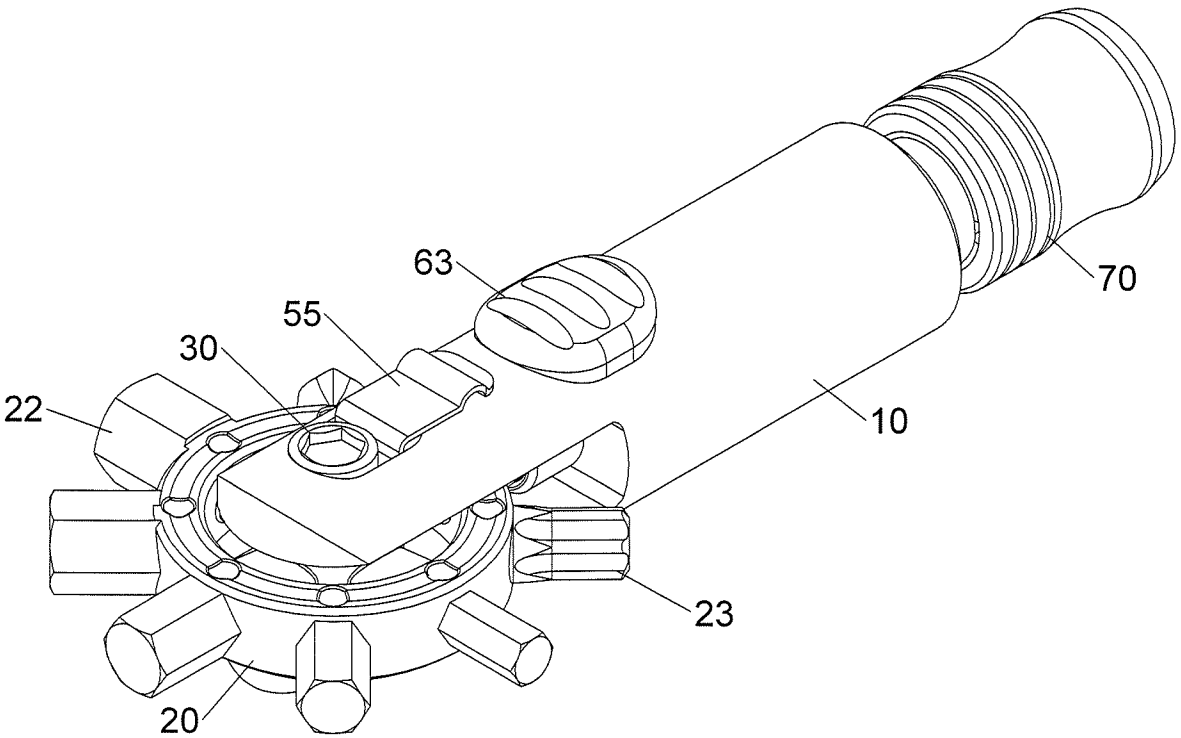
FIG. 12 is a perspective view of the fourth embodiment of the tool of the present invention.

FIGS. 11 and 12 show the fourth embodiment, wherein the positioning unit 50 has a first positioning portion 51, multiple third positioning portions 53, multiple beads 54 and a third resilient member 55. The first positioning portion 51 is the same as that disclosed in FIG. 1. The positioning portions 53 are connected to the rotary member 20. The number of the third positioning portions 53 is equal to the total number of the first bits 22 and the second bits 23. Each of the third positioning portions 53 is located corresponding to one of the first bits 22 or one of second bits 23. Each of the third positioning portions 53 is located corresponding to the first positioning portion 51 of the first body 10. The third positioning portions 53 are arranged as a circle. The positioning portions 53 each are a circular recess. The beads 54 are received in the first positioning portion 51. There are three beads 54. The bead 54 of the top of the multiple beads 54 and the bead 54 of the bottom of the beads 54 respectively and partially protrude from the first positioning portion 51. The bead 54 of the bottom of the beads 54 is engaged between one of the third positioning portions 53 and the first positioning portion 51. The third resilient member 55 is connected to the first room 111 of the first body 10 and mounted to the connector 30. The third resilient member 55 has a hole 551 defined in the first end thereof. The hole 551 is located corresponding to the first pivotal portion 11 and the connector 30 extends through the hole 551. The hole 551 of the third resilient member 55 is a circular hole. A fourth positioning portion 552 is formed on the second end of the third resilient member 55 and located corresponding to the first positioning portion 51. The bead 54 of the top of the multiple beads 54 contacts the fourth positioning portion 552. The rotary member 20 is positioned relative to the first body 10 by the at least one first positioning portion 51, the third positioning portions 53, the beads 54 and the third resilient member 55. The fourth positioning portion 552 is a circular recess, and the third resilient member 55 is a resilient plate. The assembled tool is disclosed in FIG. 12, wherein the third resilient member 55 is received in the first room 111 of the first body 10 and protrudes beyond the first body 10. The connector 30 extends through the first room 111, the hole 551 of the third resilient member 55, the first pivotal portion 11, the washer 41, the second pivotal portion 21 of the rotary member 20, and the first resilient member 40, and then is threadedly connected to the first connection portion 112 to assemble the first body 10, the rotary member 20 and the third resilient member 55.

Figure 13:
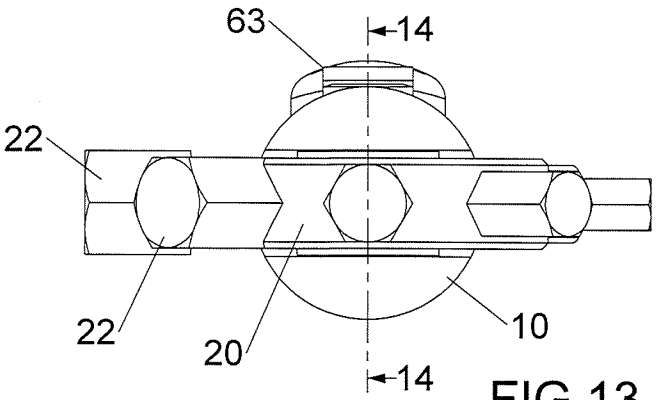
FIG. 13 is a front view of the fourth embodiment of the tool of the present invention.
Figure 14:
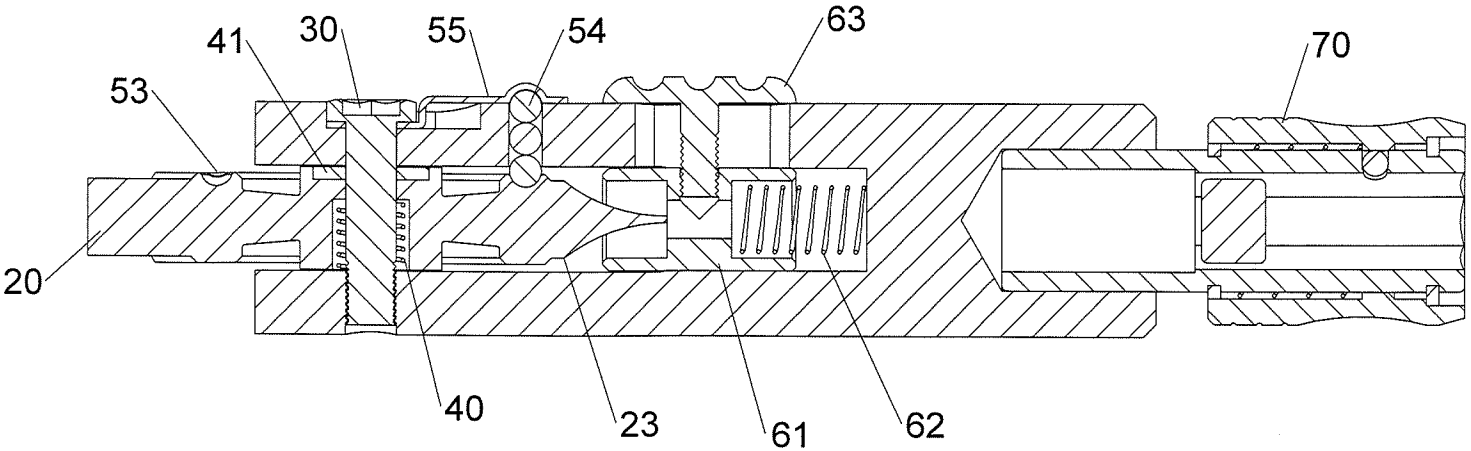
FIG. 14 is a cross sectional view, taken along line 14-14 in FIG. 13.

As shown in FIGS. 13 and 14, which show the fourth embodiment, wherein any of the third positioning portions 53 of the rotary member 20 is located corresponding to the first positioning portion 51 of the first body 10. The beads 54 are received in the first positioning portion 51. The bead 54 is engaged with the third positioning portion 53 to position the rotary member 20 relative to the first body 10. The third resilient member 55 is received in the first room 111. The connector 30 extends in the hole 551. The fourth positioning portion 552 is located corresponding to the first positioning portion 51, and the bead 54 contacts the fourth positioning portion 552.

Figure 15:
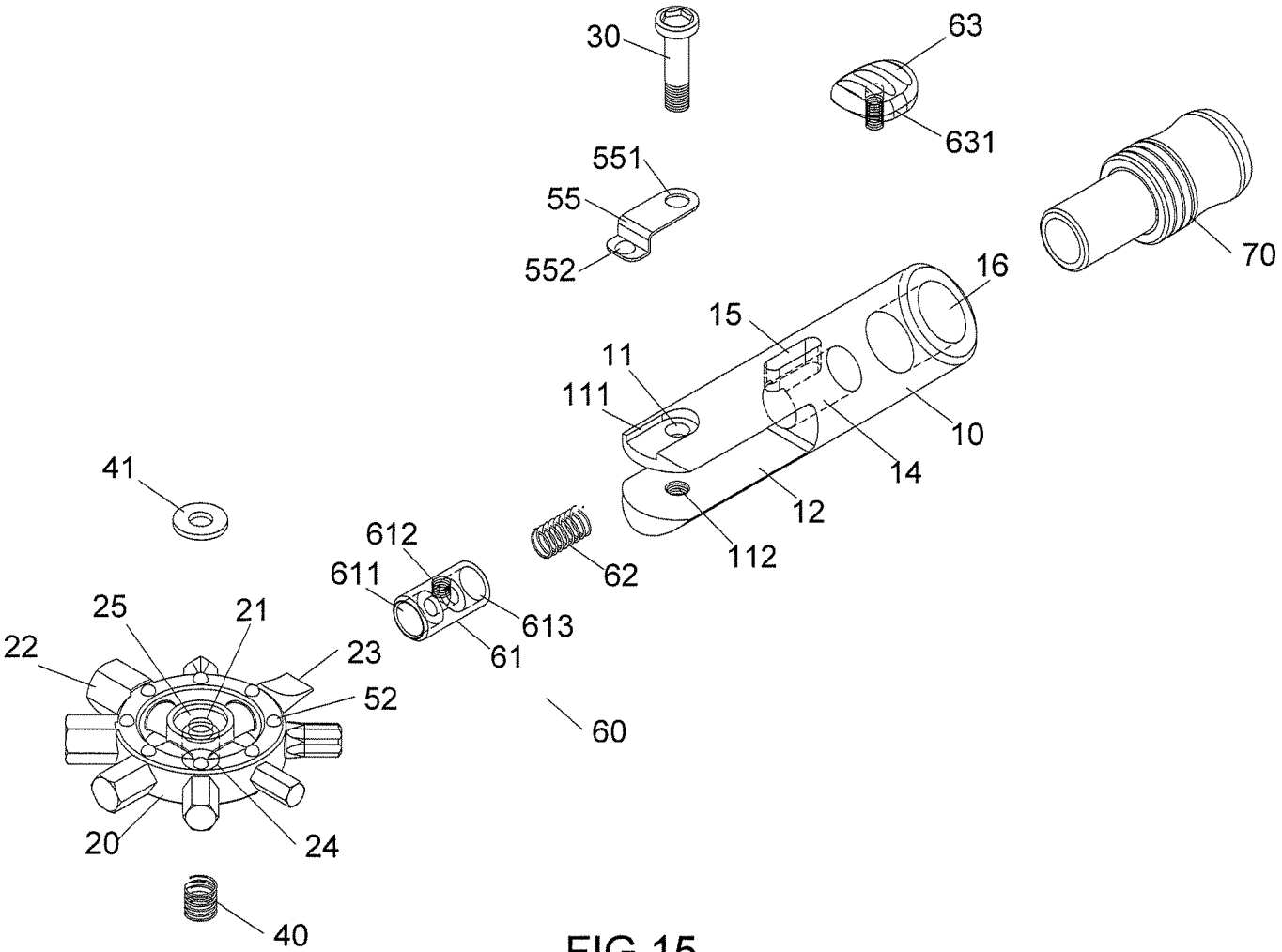
FIG. 15 is an exploded view of the fifth embodiment of the tool of the present invention.
Figure 16:
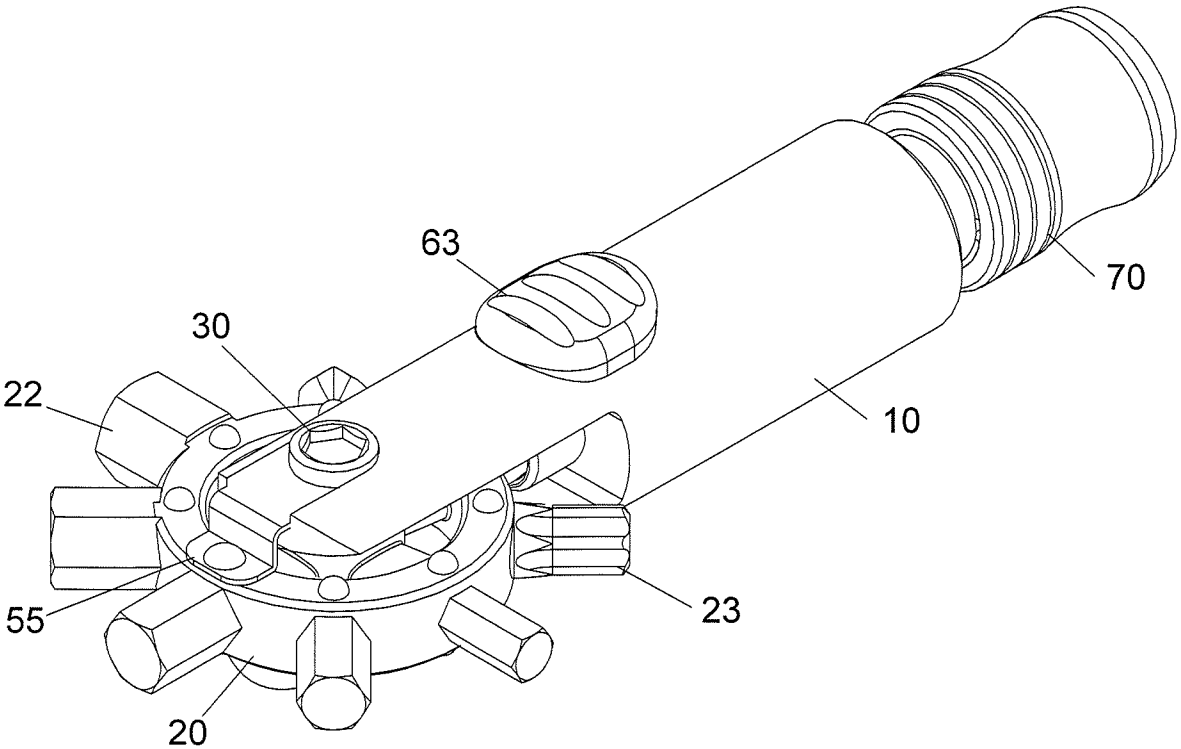
FIG. 16 is a perspective view of the fifth embodiment of the tool of the present invention.

As shown in FIGS. 15, 16 which show the fifth embodiment, wherein the positioning unit 50 has multiple second positioning portions 52 and a third resilient member 55. The second positioning portions 52 are the same as those disclosed in FIG. 1. The third resilient member 55 is connected to the first room 111 of the first body 10. The third resilient member 55 has a hole 551 defined in the first end thereof, the hole 551 is located corresponding to the first pivotal portion 11 and the connector 30 extends through the hole 551. The hole 551 of the third resilient member 55 is a circular hole. A fourth positioning portion 552 is formed on the second end of the third resilient member 55 and located corresponding to one of the second positioning portions 52. The fourth positioning portion 552 protrudes from the first body 10. The rotary member 20 is positioned relative to the first body 10 by the second positioning portions 52 and the fourth positioning portion 552. The fourth positioning portion 552 is a circular recess, and the third resilient member 55 is a resilient plate.

Figure 17:
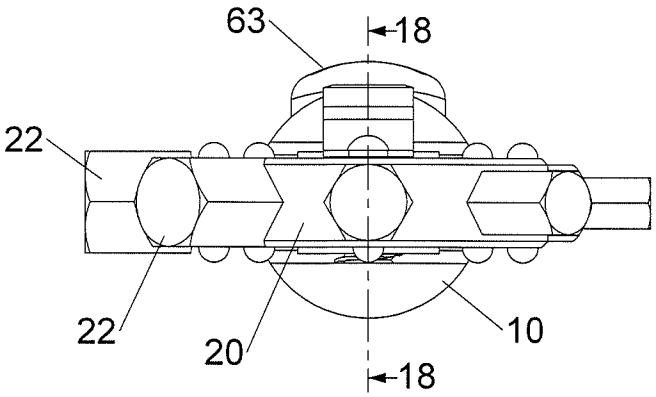
FIG. 17 is a front view of the fifth embodiment of the tool of the present invention.
Figure 18:
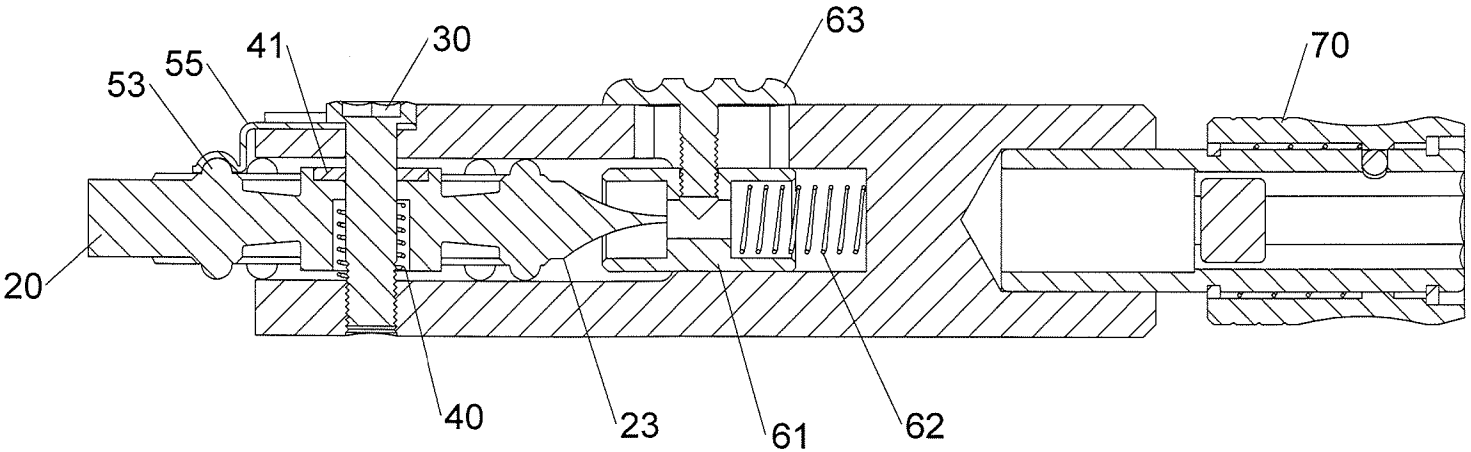
FIG. 18 is a cross sectional view, taken along line 18-18 in FIG. 17.

FIGS. 17 and 18 show the fifth embodiment, wherein the third resilient member 55 is connected to the first room 111 of the first body 10. The fourth positioning portion 552 is engaged with the second positioning portion 52 to position the rotary member 20 relative to the first body 10.

A further embodiment of the present invention shows that the first body 10 does not have the third room 25 and the washer 41. The first connection portion 112 is a circular hole and the connector 30 is snugly extends through the first connection portion 112.

There are advantages of the tool of the present invention, and are listed as follows:

1. The second positioning portions 52 and the first positioning portion 51 of the positioning unit 50 are engaged with each other. The second bit 23 of the rotary member 20 is engaged with the engaging portion 611 of the engaging member 61 to that the rotary member 20 is positioned at the first body 10 by the dual positioning feature by the positioning unit 50 and the engaging unit 60. When rotating the first body 10, and the first or second bit 22 or 23 rotates, the rotary member 20 does not freely rotate. That is to say, the rotary member 20 is positioned at the first body 10 by the dual positioning feature by the positioning unit 50 and the engaging unit 60. The rotary member 20 does not likely to freely rotate due to the disengagement happened to both of the positioning unit 50 and the engaging unit 60.

2. The slide button 63 of the engaging unit 60 is slidable in the slot 15 of the first body 10, and drives the engaging member 61 to move in the second room 14. When the user slide the slide button 63 backward, the engaging member 61 is moved backward by the slide button 63 and compress the second resilient member 62, so that the second bit 23 is disengaged from the engaging portion 611 of the engaging member 61. This is the first disengagement status. After the second bit 23 of the rotary member 20 is disengaged from the engaging member 61, the positioning unit 50 is disengaged. This is the second disengagement status. The rotary member 20 is rotatable about the first pivotal portion 11 and rotatable in the opening 12. In other words, when the rotary member 20 needs to freely rotate relative to the first body 10, the engaging unit 60 and the positioning unit 50 have to be respectively disengaged to obtain high standard of safety.

While we have shown and described the embodiment in accordance with the present invention, it should be clear to those skilled in the art that further embodiments may be made without departing from the scope of the present invention.

What is claimed is:

1. A tool comprising:

a first body having a first pivotal portion formed on a first end thereof, the first pivotal portion being a circular hole, a first room and a first connection portion respectively defined in two opposite sides of the first pivotal portion, the first room being an oval recess, an inner diameter of the first room being larger than an inner diameter of the first pivotal portion, the first connection portion having inner threads, the first body having an opening which communicates with the first pivotal portion, a second room defined in an inner end of the opening and communicating with the opening, the second room being a cylindrical room, a slot defined in the body and communicating with the second room, the slot being an elongate slot;

a rotary member pivotably connected to the first pivotal portion of the first body and being rotatable in the opening, the rotary member having a second pivotal portion which is located corresponding to the first pivotal portion, the second pivotal portion being a circular hole, the rotary member having multiple first bits and multiple second bits, the first and second bits being radially connected to the rotary member, the second pivotal portion having a first recess defined in a first end thereof, the first recess communicating with the second pivotal portion, a diameter of the first recess being larger than a diameter of the second pivotal portion, the first recess being a circular recess, a third room defined in a second end of the second pivotal portion and communicating with the second pivotal portion, the second pivotal portion located between the first recess and the third room, a diameter of the third room being larger than the diameter of the second pivotal portion, the third room being a cylindrical room;

a connector extending through the first and second pivotal portions to pivotably connect the first body to the rotary member, the connector having a first end thereof received in the first room, a second end of the connector having outer threads and being threadedly connected to the first connection portion;

a first resilient member located in the first recess of the rotary member, the first resilient member mounted to the connector and being biased between an inner end of the opening and an inner end of the first recess so that the first body resiliently contacts the rotary member by the first resilient member, and the rotary member is rotated relative to the first body with a resilient resistance;

a washer located in the third room of the rotary member and mounted to the connector, the washer being a ring-shaped washer and made of resilient material;

a positioning unit positioning the rotary member at the first body, when the positioning unit is disengaged, the rotary member is freely rotatable relative to the first pivotal portion so as to adjust an angle of the rotary member relative to the first body;

an engaging unit connected to the first body and being movable in the second room, when the engaging unit moves toward the rotary member, the engaging unit restricts the second bit and the rotary member is positioned at the first body, when the engaging unit moves away from the rotary member, the engaging unit does not restrict the second bit and the rotary member is not restricted by the engaging unit, the engaging unit comprising an engaging member, a second resilient member and a slide button, the engaging member located in the second room and being movable in the second room, the engaging member having an engaging portion on a first end thereof, the engaging portion being a circular recess so as to receive the first bit or the second bit whose outer diameter is smaller than an inner diameter of the engaging portion, the engaging portion having a second connection portion which is located corresponding to the slot, a second recess defined in a second end of the engaging member and being a circular recess;

the second resilient member received in the second recess and biased between the inner end of the second room and an inner end of the second recess so that the engaging unit resiliently contacts the first body by the second resilient member, a resilient force of the second resilient member resiliently engaging the second bit to the engaging portion, and the slide button slidably located in the slot of the first body, the slide button driving the engaging member to move in the second room, the slide button having a third connection portion which is connected to the second connection portion of the engaging member so as to drive the engaging member.

2. The tool as claimed in claim 1, wherein the first body has a reception portion defined in a second end thereof, the reception portion is a circular recess, a second body is inserted into the reception portion of the first body and is adapted to be connected with a hand tool, the second body is rotatable when rotating the first body.

3. The tool as claimed in claim 1, wherein there are five first bits which have five hexagonal heads of different sizes.

4. The tool as claimed in claim 1, wherein there are three second bits which have three bit heads of different sizes.

5. The tool as claimed in claim 1, wherein the slot and the first room are located on a common plane.

6. The tool as claimed in claim 1, wherein the second connection portion has inner threads, the second resilient member is a spring, and the third connection portion has outer threads.

7. The tool as claimed in claim 1, wherein the positioning unit has three first positioning portions and multiple second positioning portions, the first positioning portions and the first room are located on a common plane of the first body, the first positioning portions are located about the first pivotal portion, each first positioning portion communicates with the opening, one of the three first positioning portions is a circular hole which is located between the slot and the first room, the other two first positioning portions are respectively located on two sides of the first body and each are a concaved recess, the second positioning portions are located on the rotary member, a number of the second positioning portions is equal to a total number of the first and second bits, each of the second positioning portions is located corresponding to one of the first bits or one of the second bits, the first resilient member provides a resilient force which is applied to the rotary member to engage each of the second positioning portions with the first positioning portion corresponding thereto so as to position the rotary member to the first body, when one of the second positioning portions is engaged with the first positioning portion which is the circular hole, the two second positioning portions adjacent to the second positioning portion that is engaged with the first positioning portion are engaged with the other two first positioning portions which are the concaved recesses, the multiple second positioning portions are arranged as a circle and each have a protrusion or a boss.

8. The tool as claimed in claim 1, wherein the positioning unit has at least one first positioning portions, multiple third positioning portions, multiple beads and a third resilient member, the at least one first positioning portion is located on the first body and communicates with the opening, the at least one first positioning portion is a circular hole and located between the first pivotal portion and the slot, the third positioning portions are located on the rotary member, a number of the third positioning portions is equal to a total number of the first bits and the second bits, each of the third positioning portions is located corresponding to one of the first bits or one of second bits, each of the third positioning portions is located corresponding to the at least one first positioning portion of the first body, the third positioning portions are arranged as a circle, the beads are received in the at least one first positioning portion, the bead of the top of the multiple beads and the bead of the bottom of the beads respectively and partially protrude from the at least one first positioning portion, the bead of the bottom of the beads is engaged between one of the third positioning portions and the at least one first positioning portion, the third resilient member is connected to the first pivotal portion of the first body and mounted to the connector, the third resilient member has a hole defined in a first end thereof, the hole is located corresponding to the first pivotal portion and the connector extends through the hole, the hole of the third resilient member is a circular hole, a fourth positioning portion is formed on a second end of the third resilient member and located corresponding to the at least one first positioning portion, the bead of the top of the multiple beads contacts the fourth positioning portion, the rotary member is positioned relative to the first body by the at least one first positioning portion, the third positioning portions, the beads and the third resilient member.

9. The tool as claimed in claim 8, wherein the positioning portions each are a circular recess, a number of the beads is three, the fourth positioning portion of the third resilient member is a concaved recess, the third resilient member is a resilient plate.

10. The tool as claimed in claim 1, wherein the positioning unit has multiple second positioning portions and a third resilient member, the second positioning portion are located on the rotary member, a number of the second positioning portions is equal to a total number of the first bits and the second bits, each of the second positioning portions is located corresponding to one of the first bits or one of second bits, the third resilient member is connected to the first pivotal portion of the first body and mounted to the connector, the third resilient member has a hole defined in a first end thereof, the hole is located corresponding to the first pivotal portion and the connector extends through the hole to connect the third resilient member to the first body, the hole of the third resilient member is a circular hole, a fourth positioning portion is formed on a second end of the third resilient member and located corresponding to one of the second positioning portions, the fourth positioning portion protrudes from the first body, the rotary member is positioned relative to the first body by the second positioning portions and the fourth positioning portion, the fourth positioning portion is a circular recess, the third resilient member is a resilient plate.

* * * * *